US005901779A

United States Patent [19]

Eidinger et al.

[11] Patent Number: 5,901,779

[45] Date of Patent: May 11, 1999

[54] CONTINUOUS CASTING MOLD WITH A STIRRER INCORPORATING A MAGNETIC CIRCUIT

[75] Inventors: Helmut Eidinger, Schönering; Andreas Flick, Linz, both of Austria

[73] Assignee: Voest-Alpine Industrieanlagenbau GmbH, Linz, Australia

[21] Appl. No.: 08/765,750

[22] PCT Filed: Jun. 22, 1995

[86] PCT No.: PCT/AT95/00128

§ 371 Date: Dec. 31, 1996

§ 102(e) Date: Dec. 31, 1996

[87] PCT Pub. No.: WO96/01162

PCT Pub. Date: Jan. 18, 1996

[30] Foreign Application Priority Data

Jul. 1, 1994 [AT] Austria ..... 1311/94

[51] Int. Cl.[6] ..... B22D 27/02

[52] U.S. Cl. ..... 164/504; 164/468

[58] Field of Search ..... 164/502, 504, 164/466, 468

[56] References Cited

U.S. PATENT DOCUMENTS 5,664,619 9/1997 Andersson et al. ..... 164/502

*Primary Examiner*—Kuang Y. Lin
*Attorney, Agent, or Firm*—Hill & Simpson

[57] ABSTRACT

A continuous-casting mold has walls resting on an oscillating lifting platform and is provided with a stirrer which incorporates a magnetic circuit. The stirrer has a yoke which at least partially surrounds the walls of the mold and which has at least two cores facing opposite sides of the mold. In order to prevent the magnetic force of the stirrer from deforming the walls of the mold, the lifting platform, which sets the walls of the mold into oscillation, is designed as the yoke and each core is located on a bracket projecting out of the lifting platform.

12 Claims, 1 Drawing Sheet

CONTINUOUS CASTING MOLD WITH A STIRRER INCORPORATING A MAGNETIC CIRCUIT

BACKGROUND OF THE INVENTION

The invention relates to a continuous casting mold having mold side walls supported on an oscillating lifting table and having a stirrer comprising a magnetic circuit with a yoke at least partly surrounding the mold side walls and the yoke has at least two cores that are directed against mold side walls which are arranged opposite each other.

In continuous casting, the melt is caused to flow into the continuous casting mold from a tundish either directly or through a casting tube. Due to its kinetic energy, the pouring stream exiting from the tundish or exiting from the casting tube, respectively, penetrates deeply into the liquid core of the strand forming in the continuous casting mold. In this process, entrainment of slag particles, casting powder or other impurities may occur, which entrainment leads to inclusions in the strand if these impurities penetrate very far inside, since separation or flowing upward of the slag etc. to the meniscus of the strand can hardly occur any longer.

To enable control of the flow behavior of the pouring stream inside the continuous casting mold, particularly to prevent the pouring stream from penetrating too far into the liquid core of the strand, it is known to provide a stirrer directly at the continuous casting mold, which stirrer or creates causes a magnetic field that slows down the velocity of the pouring stream and, in addition, advantageously divides the pouring stream. The operation of such a stirrer is comparable to that of an electromagnetic brake.

Continuous casting molds with electromagnetic stirrers of the initially described kind are known for example from EP-B -0 265 796, EP-A - 0 401 504, EP-B - 0 286 935 and WO 92/12814. In accordance with the prior art, the yokes, which constitute a considerable mass, are arranged stationarily to avoid loading the oscillation drives for the mold side walls with these masses. Mostly, the iron cores likewise have been stationarily arranged, in order to avoid loading the oscillation drives with these masses as well. The yoke that has to be additionally provided at the continuous casting mold not only causes substantial structural expenditures (in that additional neon in the very confined space of the continuous casting mold room has to be made for this yoke), but also renders mold construction more expensive due to the additional expenditures incurred for the material.

To enable perfect oscillation of the mold side walls relative to the stationarily arranged stirrer, an air gap is provided between each of the cores of the stirrer and the mold side walls. As a consequence, considerable magnetic forces arise during the operation of the stirrer, which act on the mold side walls and cause a deformation of the mold side walls in the direction toward the core or the yoke. With continuous casting molds for casting a strand having a slab cross section, the molds are constructed as plate molds having broad side walls and narrow side walls clamped between the broad side walls. The narrow side walls either will be clamped only to an unsatisfactory degree by the broad side walls which are acted upon by the magnetic forces, or the forces acting from the stirrer will have to be compensated for by the clamping forces. In the latter case, excessive clamping forces exist between the broad and n arrow side walls when the stirrer is de-engized or put out of action.

It is internally known to rigidly arrange the iron core in the broad side walls of a mold provided for casting a strand having a slab cross section, and the yoke in this case is arranged at a certain distance from the iron cores which are integrated into the broad side walls of the continuous casting mold. Here too, deformations result during the operation of the stirrer, due to the air gap between yoke and core and due to the forces drawing the broad side walls toward the yoke.

A further disadvantage of this construction has to be seen in that for each mold there has to be provided a separate stirrer, which also has to be exchanged whenever the mold side walls are exchanged (for instance in order to change the strand format, etc.).

A continuous casting mold of the initially described kind in which the lifting table that imparts an oscillating movement to the mold side walls is constructed as a yoke, is known from WO-A -94/16844. However, this document does not disclose how the cores are arranged.

SUMMARY OF THE INVENTION

The invention aims at avoiding these disadvantages and difficulties and has as its object to create a continuous casting mold of the initially described kind, in which the expenditures for material are only negligibly higher as compared to a continuous casting mold without a stirrer, in which the spatial conditions as compared to a continuous casting mold without a stirrer are only negligibly confined and in which, during operation of the stirrer, the forces that are caused by the stirrer and act on the mold side walls can be avoided. A further essential criterion is that the slight masses to be moved by the oscillation drive for the mold side walls.

In accordance with the invention, this object is achieved in that the lifting table, which imparts an oscillating movement to the mold side walls, is constructed as a yoke and each core is arranged at a console rising up from the lifting table. With this construction, the separate arrangement of a yoke at the continuous casting mold becomes unnecessary, and therefore, the structural expenditures are very low. It is merely necessary to adjust the lifting table to the magnetic requirements in terms of the iron cross sections and to provide it with consoles that carry the cores. As the lifting table naturally moves synchronously with the mold side walls supported on it, it is not necessary to provide air gaps between the lifting table, i.e. the yoke, the cores and the mold side walls in order to enable relative motion between these parts. In accordance with the invention, direct contact is provided between these parts, so that deformations caused by magnetic forces can no longer occur.

To enable particularly simple replacement of the mold for casting strands of different cross-sectional formats, particularly of different thicknesses, one and the same stirrer can be utilized for continuous casting molds having different cross-sectional formats. To be able to exchange the continuous casting mold in the shortest time possible, without any delays being caused by the stirrer, in accordance with a preferred embodiment, the cores are adjustable relative to the lifting table and the consoles in a direction roughly perpendicular to the mold side walls. Preferably openings in the consoles are provided for receiving the cores. From JP-1-289550 it is known to arrange cores in electromagnetic devices of continuous casting molds within the electromagnetic device in such a manner that they are movable in the horizontal direction and, the direction of adjustment is oriented perpendicular to the side walls of the continuous casting mold.

Due to the movability of the cores relative to the yoke, the cores during the operation of the stirrer can be adjusted against the mold side walls until they are in contact with the same, leaving no vertical air gap between the cores and the mold side walls. The cores are automatically drawn to the mold side walls by the magnetic forces caused by the stirrer.

Preferably, the cores are constructed such as to be divided in a direction roughly parallel to the extension of the mold side walls, against which they are directed, wherein suitably one part of each of the cores is rigidly attached to a mold side wall and one part is adjustably mounted on the lifting table. Hereby it becomes feasible to make the cores project from the copper plates of the mold side walls, hence making them project through the supporting structure of the mold side walls that reinforces the copper plates without having to provide for very large dimensions for the path of adjustment of the cores during mold replacement.

For simple adjustment of the adjustable part of the core, the latter is movable relative to the part of the cores that is attached to the mold side wall and vice versa by an adjusting means, wherein advantageously, via brackets, the adjusting means is on the one hand connected with the lifting table and on the other hand with the movable part of the core.

Preferably, the parts of the cores that are adjustable relative to the lifting table carry one coil each, such that when exchanging the continuous casting mold it is feasible for the coils to remain in the continuous casting plant. Advantageously the adjustable part carries the coil at its one end that is directed against the mold side wall.

According to a preferred embodiment, the path of adjustment of the cores is dimensioned such that strand guiding means, such as a bending zone, that are arranged below the continuous casting mold can be removed and inserted through the lifting table carrying the cores.

A structurally simple variant is characterized in that the cores are arranged so as to be stationary relative to the lifting table.

DESCRIPTION OF THE PREFERRED EMBODIMENTS

Figure 1:
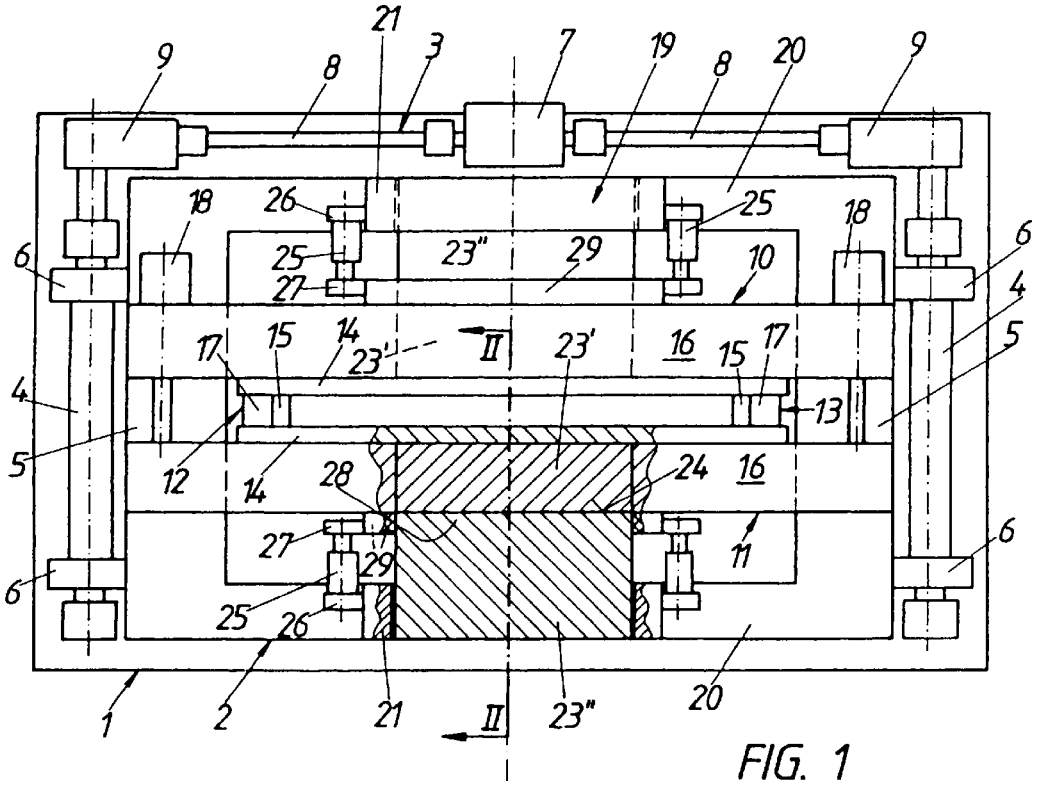
FIG. 1 is a schematic top plan view with portions broken away of a continuous casting mold of the present invention.
Figure 2:
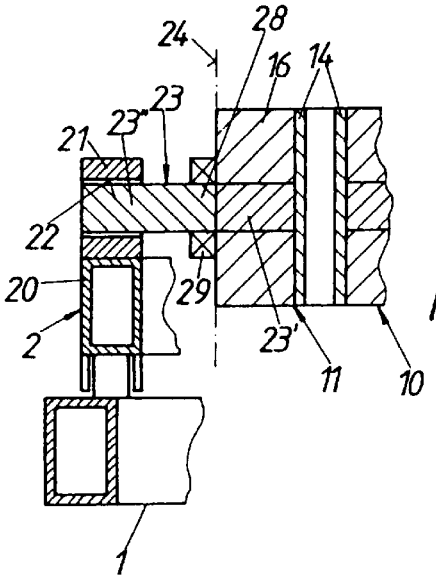
FIG. 2 is a partial cross sectional view taken on line II—II of FIG. 1.

In accordance with the exemplary embodiment illustrated in FIGS. 1 and 2, a lifting table 2 constructed in a frame-like manner is supported on the frame 1, which is stationary, i.e. which rests on the foundation, by an oscillation drive 3. The oscillation drive 3 is provided with eccentric shafts 4 extending along the short sides 5 of the rectangular lifting table 2 and imparting a vertical lifting and lowering motion to the lifting table 2 via brackets 6 hinged to the lifting table 2. To guide the lifting table 2 in the vertical direction, guide elements not illustrated in detail are provided between the lifting table 2 and the stationary frame 1. The two eccentric shafts 4 are driven synchronously by a driving motor 7 connected with the eccentric shafts 4 via spacer shafts 8 and corner gears 9.

The mold side walls 10, 11, 12, 13 of the continuous casting mold, which is constructed as a plate mold, are supported on the lifting table 2. All mold side walls 10 to 13 are constructed as individual plates and are formed by copper plates 14, 15 arranged on the inside and supporting plates 16, 17 supporting the same. The continuous casting mold illustrated in FIGS. 1 and 2 serves for casting a strand having a slab cross section, preferably for casting a strand having a thin slab cross section. Its broad side walls 10, 11 are supported directly on the lifting table 2; the narrow side walls 12, 13 are clamped between the broad side walls 10, 11 by the schematically illustrated clamping means 18.

A stirrer 19 which comprises a magnetic circuit is formed by the lifting table 2 being constructed as the yoke of the stirrer 19, i.e. the wall cross sections of the table 2 are adjusted in accordance with the magnetic requirements concerning the necessary cross-sectional area. At the frame parts 20 of the lifting table 2, which parts 20 are disposed parallel to the broad side walls 10, 11, consoles or brackets 21 are arranged, which consoles 21 rise vertically upward and are provided with one opening 22 each for receiving one iron core 23.

Each of the iron cores 23 extends roughly horizontally and perpendicular to the planes formed by the broad side walls 10, 11 as far as the copper plates 14 of the latter, which plates 14 are arranged on the inside. Each of the cores 23 is constructed so that it is divided into two parts 23', 23", with the dividing plane 24 extending roughly parallel to the planes formed by the broad side walls 10, 11. One of the parts 23', 23" of each core 23, namely part 23', is stationarily mounted within the supporting plate 16, projects as far as the copper plate 14 and terminates approximately flush with the exterior of the supporting plate 16. The other part 23" of each of the cores 23 is inserted in the opening 22 of the console 21 and is adjustable in a direction roughly perpendicular to the planes formed by the broad side walls 10, 11, namely by adjusting means 25. Each adjusting means 25 is connected on the one hand with the lifting table 2, i.e. at the consoles 21, via brackets 26 and on the other hand with the movable part 23" of the cores 23 via brackets 27. At their ends 28, which are directed against the core parts 23' stationarily inserted in the supporting plates 16, the movable parts 23" of the cores 23 carry electric coils 29. Instead of as electric coils 29, the cores 23 can also be constructed as permanent magnets.

Due to the occurrence of magnetic forces during the operation of the stirrer, the movable part 23" of the core 23 is automatically drawn to the part 23' that is immovable, i.e. to the part 23' of the core 23 that is inserted in the broad side walls 10, 11, and thus reliably avoids an air gap which is capable of causing the broad side walls 10, 11 to be deformed by these magnetic forces. The exchange of the mold side walls 10 to 13 is very easy to accomplish; by means of the adjusting means 25, and the part 23", which is adjustably supported on the lifting table 2, simply has to be moved to a position where it occupies a space located at a certain distance from the part 23' of the core 23 that is integrated into the broad side walls 10, 11. The broad side walls 10, 11 can then be conveniently removed along with the narrow side walls 12, 13 and replaced with intact ones or with ones of a different format, etc.

It can be seen that the new broad side walls 10, 11 just have to be provided with a part 23' of the core 23 that is integrated in the supporting plates 10, 11 and that the remaining parts of the stirrer 19, namely the yoke (lifting table 2) and the adjustable core part 23" plus coil 29 are suitable for all mold side walls 10 to 13 that can be inserted on the lifting table 2, and that it is therefore not necessary to exchange these parts of the device. This not only results in a very short mold exchange time but also in cost-advantageous construction.

Herein, the adjustability of the adjustable parts 23" of the cores 23 is dimensioned such that—if necessary—even strand guiding elements arranged below the continuous casting mold—such as for instance a bending zone—can be removed through the lifting table 2 without having to remove the lifting table 2 or the parts 23" of the cores 23 from the continuous casting plant. The parts 23" of the cores 23 can be formed by two or several parts which are rigidly connected with each other, for instance are flanged to each other, for example for easier production of these parts or for their easier removal and insertion.

We claim:

1. A continuous casting mold comprising an oscillating lifting table, mold side walls supported on a surface of the table with two side walls being positioned opposite each other and having plane surfaces, and a stirrer having a magnetic circuit, said oscillating table forming a yoke for the magnetic circuit and said magnetic circuit including at least two cores, said table having a console on said surface for supporting each core on the table to extend in opposite directions and in direct contact with the two side walls.

2. A continuous casting mold according to claim 1, wherein the cores are mounted on the console for adjustment relative to the lifting table in a direction extending roughly perpendicular to the plane surfaces of the two side walls.

3. A continuation casting mold according to claim 2, wherein each core carries a coil.

4. A continuous casting mold according to claim 2, wherein the path of the adjustment of the comes is dimensioned so that stranding guide means, which are arranged below the continuous casting mold, can be removed and inserted through an opening In the lifting table.

5. A Continuous casting mold comprising an oscillating lifting table, mold side walls supported on a surface of the table with two side walls being positioned opposite each other and having plane surfaces, and a stirrer having a magnetic circuit, said oscillating table forming a yoke for the magnetic circuit and said magnetic circuit including at least two cores, said table having a console an said surface for mounting each core for adjustment relative to the lifting table in a direction extending roughly perpendicular to the plane surface of the two side walls and into direct contact with the two side walls and each core being divided into two parts along a plane extending substantially parallel to the plane surfaces of the two side walls.

6. A continuous casting mold according to claim 5, wherein one part of the two parts of each core is adjustably mounted in an opening in the console and the other part of the two parts is rigidly attached to a mold side wall.

7. A continuous casting mold according to claim 6, which includes adjustment means for moving the one part in the opening of the console relative to the other part attached to the mold side wall.

8. A continuous casting mold according to claim 7, wherein the adjustment means is connected to the console and has a connection formed by a bracket to the one part which is movable in the opening of the console.

9. A continuous casting mold according to claims 5, 6, 7 or 8, wherein each one part of the two-part core carries a coil.

10. A continuous casting mold according to claim 9, wherein the one part has the coil mounted at one end which is directed against the other part of the core.

11. A continuous casting mold according to claims 2, 5, 6, 7, or 8, wherein the path of the adjustment of the cores is dimensioned so that stranding guide means, which are arranged below the continuous casting mold, can be removed and inserted through an opening in the lifting table.

12. A continuous casting mold according to claim 1, wherein the consoles hold the cores stationary relative to the lifting table.

* * * * *

UNITED STATES PATENT AND TRADEMARK OFFICE

CERTIFICATE OF CORRECTION

PATENT NO. : 5,901,779
DATED : May 11, 1999
INVENTOR(S) : Eidinger et al.

It is certified that error appears in the above-identified patent and that said Letters Patent is hereby corrected as shown below:

Title page,
The Assignee is corrected to read:
Voest-Alpine Industrieanlagenbau GmbH, Linz, Austria Signed and Sealed this Nineteenth Day of March, 2002

*Attest:*

*Attesting Officer*

JAMES E. ROGAN
*Director of the United States Patent and Trademark Office*